US006955610B1

(12) United States Patent
Czaja et al.

(10) Patent No.: US 6,955,610 B1
(45) Date of Patent: Oct. 18, 2005

(54) SPORTS TRAINING APPARATUS

(75) Inventors: David Czaja, Norwalk, CT (US); John Adinolfi, Fairfield, CT (US); Arthur Greene, Stamford, CT (US); Gil R. Tatarsky, Kingston, NY (US)

(73) Assignee: Ketema, LLC, Kingston, NY (US)

( * ) Notice: Subject to any disclaimer, the term of this patent is extended or adjusted under 35 U.S.C. 154(b) by 0 days.

(21) Appl. No.: 10/728,494

(22) Filed: Dec. 5, 2003

Related U.S. Application Data

(60) Provisional application No. 60/431,219, filed on Dec. 5, 2002.

(51) Int. Cl.[7] ..... A63B 69/36
(52) U.S. Cl. ..... 473/256; 473/220; 473/226
(58) Field of Search ..... 473/219, 220, 473/233, 224, 226, 234, 256; 273/456; 426/634; 434/168; 446/129; 482/109

(56) References Cited

U.S. PATENT DOCUMENTS

| | | | | |
|---|---|---|---|---|
| 2,135,646 | A | 11/1938 | Stumpf | |
| 2,135,648 | A * | 11/1938 | Stumpf | 473/233 |
| 2,950,115 | A * | 8/1960 | Hurdzan | 473/234 |
| 3,136,553 | A * | 6/1964 | Davis | 473/233 |
| 3,677,553 | A * | 7/1972 | Moore | 473/220 |
| 4,027,886 | A | 6/1977 | Katsube | |
| 4,295,832 | A * | 10/1981 | Karell | 434/168 |
| 4,614,343 | A | 9/1986 | Radway | |
| 4,634,121 | A * | 1/1987 | Sasaki | 473/457 |
| 4,809,975 | A | 3/1989 | Lee | |
| 4,969,921 | A | 11/1990 | Silvera | |
| 5,360,209 | A | 11/1994 | Mollica | |
| 5,505,454 | A | 4/1996 | Gagarin | |
| 5,527,038 | A | 6/1996 | Mabie | |
| 5,577,966 | A | 11/1996 | Duran | |
| 5,580,321 | A | 12/1996 | Rennhack | |
| 5,582,407 | A | 12/1996 | Sorenson | |
| 5,599,021 | A | 2/1997 | Lary et al. | |
| 5,634,856 | A | 6/1997 | Rainey | |
| 5,653,664 | A | 8/1997 | Jennings | |
| 5,711,718 | A | 1/1998 | Mueller | |
| 5,807,183 | A | 9/1998 | Benson | |
| 5,860,873 | A | 1/1999 | Karasavas | |
| 5,868,634 | A | 2/1999 | Choi et al. | |
| 5,989,131 | A | 11/1999 | Burkholder | |
| 6,083,116 | A | 7/2000 | Loredo | |
| 6,120,385 | A | 9/2000 | Nemeckay | |
| 6,186,904 | B1 | 2/2001 | Bass | |

* cited by examiner

*Primary Examiner*—Gregory Vidovich
*Assistant Examiner*—Nini F. Legesse
(74) *Attorney, Agent, or Firm*—McCarter & English, LLP

(57) ABSTRACT

An apparatus is provided that allows individuals of diverse skill levels to improve their respective sports-related swings. The apparatus provides visual, auditory and tactile feedback as to whether an individual is correctly "loading", "retaining", and "releasing" the inherent power of the training apparatus. The training apparatus enables an individual to fine tune his/her swing to maximize power delivery, e.g., in driving a golf ball, striking a hockey puck, or hitting a baseball. A slidable member is provided that moves along a shaft between an upper member and a lower member. A retaining mechanism restrains the slidable member in a cocked position, i.e., in juxtaposition with the upper member, until a predetermined force is created through swinging of the shaft.

15 Claims, 8 Drawing Sheets

SPORTS TRAINING APPARATUS

CROSS-REFERENCE TO RELATED APPLICATION(S)

The present application claims the benefit of a commonly assigned provisional application entitled "Golf Swing Training Apparatus" that was filed on Dec. 5, 2002 and assigned Ser. No. 60/431,219. The entire contents of the foregoing provisional patent application are incorporated herein by reference.

BACKGROUND OF THE DISCLOSURE

1. Technical Field

The present disclosure relates to a method for improving an individual's swing in sports-related activities and to apparatus and methods for effectuating the same. More particularly, the present disclosure is directed to training apparatus and methods having particular applicability to improving a golf swing that incorporate the use of a training apparatus having a sliding weight member mounted to a shaft portion of that apparatus that is adapted and configured to help an individual to increase head speed and/or improve control over ball flight characteristics.

2. Background of Related Art

The literature of golf instruction is replete with advice and observations on the dynamics of a proper swing. It includes theories regarding creating power and how the "clubshaft" or "clubhead" must be swung in relationship to the golfer's body. The specific movements, which the body must make in order to strike a golf ball accurately and for distance, have been examined and written about in detail for years. With the aid of technology developed over the last 40 years, golf professionals and scientists have come into agreement as to what specific body movements contribute to a powerful and accurate swing.

It has been established and proven scientifically that the most accurate way to generate speed and thus power into the clubhead and clubshaft at impact is to utilize "centrifugal force" and to transfer momentum/energy down the clubshaft and out into the clubhead. A model golf swing "loads", "retains", and "releases" energy throughout the swing such that the clubhead is accelerating as it approaches the ball and reaches peak velocity in this impact zone.

PGA Teaching Professionals recognize that the average golfer is "spent" prior to impact due to a "pre-mature release" of power. The premature release of power results from a misdirected effort to accelerate the clubhead with his/her hands early in the downswing. More specifically, most novice golfers decrease the wrist-cock angle well prior to reaching the impact zone, which results in significantly less clubhead speed when the clubhead contacts the ball.

Golfers and golf professionals have trained ceaselessly in an effort to "groove" the proper swing so as to produce a ball flight which is long and has the desired flight characteristics (i.e., height, curvature, and spin). Many devices have been created for training golfers to reproduce a proper golf swing. Some of these devices are complicated, misleading and based on unscientific theory and have hurt more golfers then they have helped. Several weighted devices have been developed which are designed to increase clubhead velocity, but these devices inaccurately replicate how power is "loaded", "retained", and "released" in a proper golf swing. Still further, these previously proposed weighted devices are either incapable of accurately allowing the golfer to experience true momentum/energy transfer, or do not sufficiently provide the much sought after feedback of a correct motion. Additionally, none of the prior art training devices help the user adjust the striking of the ball so as to create a desired flight. More specifically, none of the prior art weighted devices aid in the reduction/elimination of slicing or hooking nor do they help develop the ability to impart a draw or a fade on the ball flight.

There is a need therefore, for training apparatus and methods in connection with sports-related activities, e.g., golf, baseball and the like, that provide the user with the proper feedback during a practice swing on "retaining" the potential energy and wrist-cock until the correct moment of release. Additionally, there is a need for apparatus and methods that simultaneously provide auditory, visual and sensory feedback as to what specific movements are required to improve ball striking and/or to generate desired ball flight characteristics, such as trajectory, height and curvature.

SUMMARY OF THE DISCLOSURE

The present disclosure is directed to methods and apparatus for use in improving an individual's sports-related swing. Exemplary apparatus according to the present disclosure include an elongated shaft having an upper portion, a lower portion and a central portion extending therebetween. The shaft defines a longitudinal axis for the apparatus and has a circular cross-section. However, other cross-sections, such as hexagonal and octagonal are envisioned. A grip may be disposed over the shaft and extend axially over the upper portion of the shaft. A weight member is engaged with or mounted with respect to a central portion of the shaft and is adapted and configured for movement between the upper portion and the lower portion of the shaft, e.g., when the apparatus is swung by an individual. In an exemplary embodiment of the disclosed apparatus, the weight member has a center of mass which is offset from the central axis of the shaft.

The upper and lower portion of the shaft include blocking mechanisms that are configured to ensure that the weight member slides over the central portion of the shaft, between the upper and lower portions. The blocking member associated with the upper portion of the shaft further includes a restraining mechanism which prevents the axial movement of the weight member until a pre-selected restraining force is overcome. Exemplary embodiments of the disclosed apparatus further include a mechanism for preventing the weight member from rotating about the shaft axis when the weight member is sliding axially along the central portion of the shaft.

The apparatus and method of the present disclosure advantageously provide visual, auditory and tactile feedback as to whether or not an individual is correctly "loading", "retaining", and "releasing" the inherent power of the training apparatus. The apparatus and method of the present disclosure may also provide valuable feedback as to the accuracy to be achieved through an individual's swing, and information that may be used to identify what specific movements may be required to improve object striking, e.g., a golf ball, a baseball, a hockey puck, etc., and to generate desired flight characteristics for such object, such as, trajectory, height and curvature.

Additional features and advantageous functions associated with the disclosed apparatus and method will be apparent from the detailed description which follows, particularly when taken together with the appended figures.

BRIEF DESCRIPTION OF THE DRAWINGS

So that those having ordinary skill in the art to which the present application appertains will more readily understand how to make and use the same, reference may be had to the drawings wherein.

These and other features of the subject disclosure will become more readily apparent to those having ordinary skill in the art from the following detailed description of exemplary embodiments.

DETAILED DESCRIPTION OF EXEMPLARY EMBODIMENTS

As noted above, the present disclosure is directed to methods and apparatus that provide individuals of diverse skill levels to improve their respective sports-related swings. The disclosed apparatus and method advantageously provide visual, auditory and tactile feedback as to whether an individual is correctly "loading", "retaining", and "releasing" the inherent power of the training apparatus. Thus, the training apparatus of the present disclosure enables an individual to fine tune his/her swing to maximize power delivery, e.g., in driving a golf ball, striking a hockey puck, or hitting a baseball. The disclosed apparatus and method may also provide valuable feedback as to the accuracy to be achieved through an individual's swing, and information that may be used to identify what specific movements may be required to improve object striking, e.g., a golf ball, a baseball, a hockey puck, etc., and to generate desired flight characteristics for such object, such as, trajectory, height and curvature.

Although the present disclosure is described with reference to a series of exemplary embodiments having primary application as golf swing training apparatus, it is to be understood that the advantageous principles, functions and structural features disclosed with reference to such exemplary embodiments may be readily extended to alternative sports training applications. Thus, for example, the disclosed swing training apparatus may be extended to alternative sports training apparatus such as a baseball swing training apparatus, a tennis swing training apparatus, a hockey swing training apparatus and a field hockey swing training apparatus. In each such application, the disclosed swing training apparatus may be employed to provide valuable feedback to an individual concerning his/her swing and steps that may be taken to improve such swing.

Figure 1:
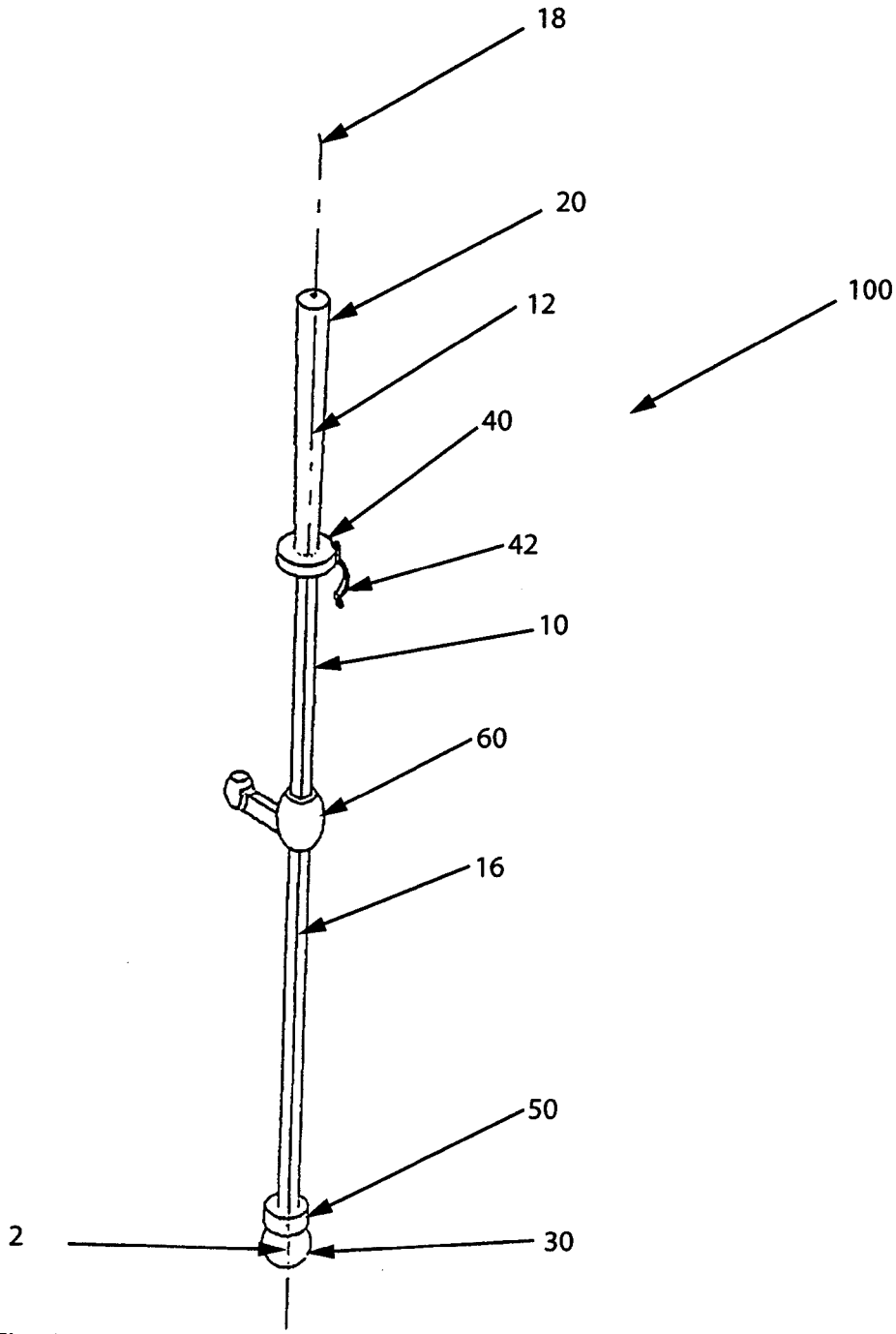
FIG. 1 is a perspective view of an exemplary embodiment of a swing training apparatus of the present disclosure.

Referring now to the drawings wherein like reference numerals identify similar elements of the subject disclosure, there is illustrated in FIG. 1 a golf swing training apparatus designated generally by reference numeral 100. Swing trainer 100 includes shaft 10 which can be segmented into an upper portion 12, a lower portion 14 and a central portion 16, which extends between the upper and lower portions, 12 and 14, respectively. In the embodiment disclosed herein, the length of a shaft is preferably approximately equal to the length of a "standard" 5 iron. However, those skilled in the art will readily appreciate that the length can be adjusted to replicate other golf clubs or be reduced so that the swing trainer can be used indoors.

A rubber grip 20 is disposed over the upper portion 12 of shaft 10 and is configured so that the user (not shown) can utilize a standard two-handed grip. As shown, the grip 20 is tapered, but other configurations are acceptable, such as, for example, a molded grip, similar to a professional grip. The grip can be attached to the shaft by any conventional bonding technique.

A ball 30 is affixed to the lower portion 14 of the golf shaft 10 and is sized to be representative of a standard golf ball. By mounting a ball at the end of the shaft 10, visual imagery referred to by teaching professionals as "ball flinging" is created during the swing. Ball flinging is the simple mental image of "flinging" the ball off of the end of the clubshaft towards the intended target. Teaching professionals believe that humans instinctively know how to create power and think that ball flinging aids golfers in bringing out this natural skill. It should be noted that the use of other elements at the end of the shaft, in lieu of a golf ball, is not a departure from the inventive aspects of the present disclosure.

A weight member 60 is slidably engaged with respect to shaft 10 and is adapted and configured for axial movement between an upper sleeve 40 and a lower sleeve 50. The upper sleeve 40 includes a mechanism for detachably retaining weight member 60 in juxtaposition with upper sleeve 40. For purposes of exemplary swing trainer 100, the mechanism for detachably retaining weight member 60 in juxtaposition with upper sleeve 40 is clip 42, which restrains the longitudinal movement of the weight member 60 when it is engaged therewith. The weight member can be fabricated out of any rigid material including but not limited to PVC, plastic, steel or the like.

In accordance with the present disclosure, the weight member 60 is free to move as the golfer makes his/her swing and visual, auditory, and sensory feedback is given as the weight member 60 is "loaded" during the backswing, "retained" at the top of the swing and "released" during the downswing in the impact zone. As will be understood, a golfer will gain awareness of how energy should be properly applied to the golf ball in order to gain peak velocity at impact—simulating the "release" of a golf ball down the fairway. The clip 42 allows the golfer the option to "pre-load" the weight member 60 at the upper portion of the swing trainer 100. Thus, the user has the option to make swings at "normal" speed, only experiencing the "retaining" and "unloading" features of the device.

Clip 42 can be configured such that the clamping force that it applies to the weight member 60 can be selectively adjusted. This allows the restraining force to be set so as to be based on the user's swing strength and corresponding swing speed. Those skilled in the art would readily appreciate that in alternative embodiments, clip 42 can be replaced with other restraining devices, such as magnets, without departing from the inventive aspects of the present disclosure. U.S. Pat. No. 4,027,886 to Katsube discloses a swing trainer which includes a magnet element for restraining the longitudinal movement of the weight member 60.

Figure 2:
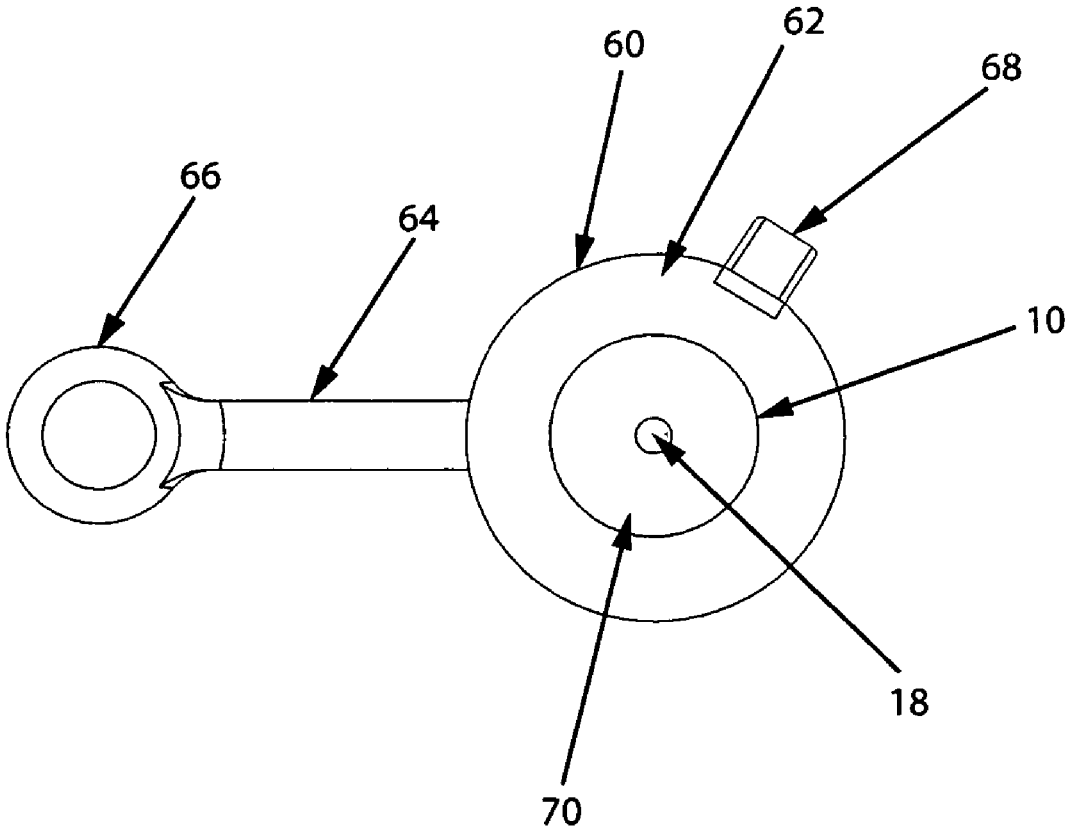
FIG. 2 is a top sectional view showing a weight member oriented in a neutral position.

Referring now to FIG. 2, weight member 60 is illustrated in cross-section. Weight member 60 includes a main body portion 62 having an inside diameter 70 which is adapted and configured for allowing the weight member 60 to slide axially along the center portion 16 of shaft 10. Unlike conventional swing trainers, weight member 60 has an arm 64 and a mass 66 extending from the main body portion 62. By offsetting mass 66 from the main body portion 62, weight member 60 has a center of gravity or mass which is offset from shaft axis 18. As a result of this offset, a torque is imparted on the shaft 10 which has a magnitude that can be approximated as follows:

Torque=Force*distance

Force=weight of weight member 60

Distance=length from center of gravity to the shaft axis 18

The application of torque to the shaft will allow the user to improve his/her ball striking so as to be able to eliminate undesired slicing or hooking. Alternatively or additionally, the user can utilize the torque feature to learn how to impart a draw or a fade on the ball flight. Exemplary methods for using the torque feature to achieve improved striking and/or to adjust the ball flight characteristics will be detailed hereinbelow.

It should be noted that the amount of torque applied to the shaft can be adjusted in many ways. For example, mass 66 can be connected to arm 64 by helical threads (fine series preferably) and therefore, be removable. Mass elements of different weights can be selectively engaged with the arm so as to increase or decrease the amount of torque. Additionally, the arm 64 can also be adapted to be removable so that arms of different length can be used. Those skilled in the art would readily appreciate that a number of alternate approaches can be used to selectively adjust the amount of torque that is imparted on the shaft, and the disclosed embodiments are not intended to be limiting with respect thereto. Additionally, the weight member 60 may include more than one arm 64 for supporting the mass 66 in an offset manner so as to reduce the amount of shear force applied at the base (i.e., end adjacent to main body portion 62) of the arm 64.

With continuing reference to FIG. 2, weight member 60 also includes a set screw 68 which prevents the weight member from rotating about the shaft axis. The set screw in a representative embodiment is adapted for sliding within a longitudinal groove (not shown) formed in the shaft 10. The screw 68 also allows the angular position weight member 60 to be fixed with respect to the user of swing trainer 100.

As shown in FIG. 1, shaft 10 has an axial cross-section which is square. However, the shaft can have other cross-sections, such as, for example, circular, hexagonal, or octagonal. The inside diameter 70 of the weight member 60 would be adjusted to accommodate the cross-section of the shaft 10. Additionally, the shaft can be adapted to be positioned over a standard golf club shaft so that the training device can be used to strike golf balls. In this embodiment, it is envisioned that the shaft 10 is constructed from two halves which define a central core. Several conventional techniques can be used to fixably position the shaft around the club shaft.

Figure 3:
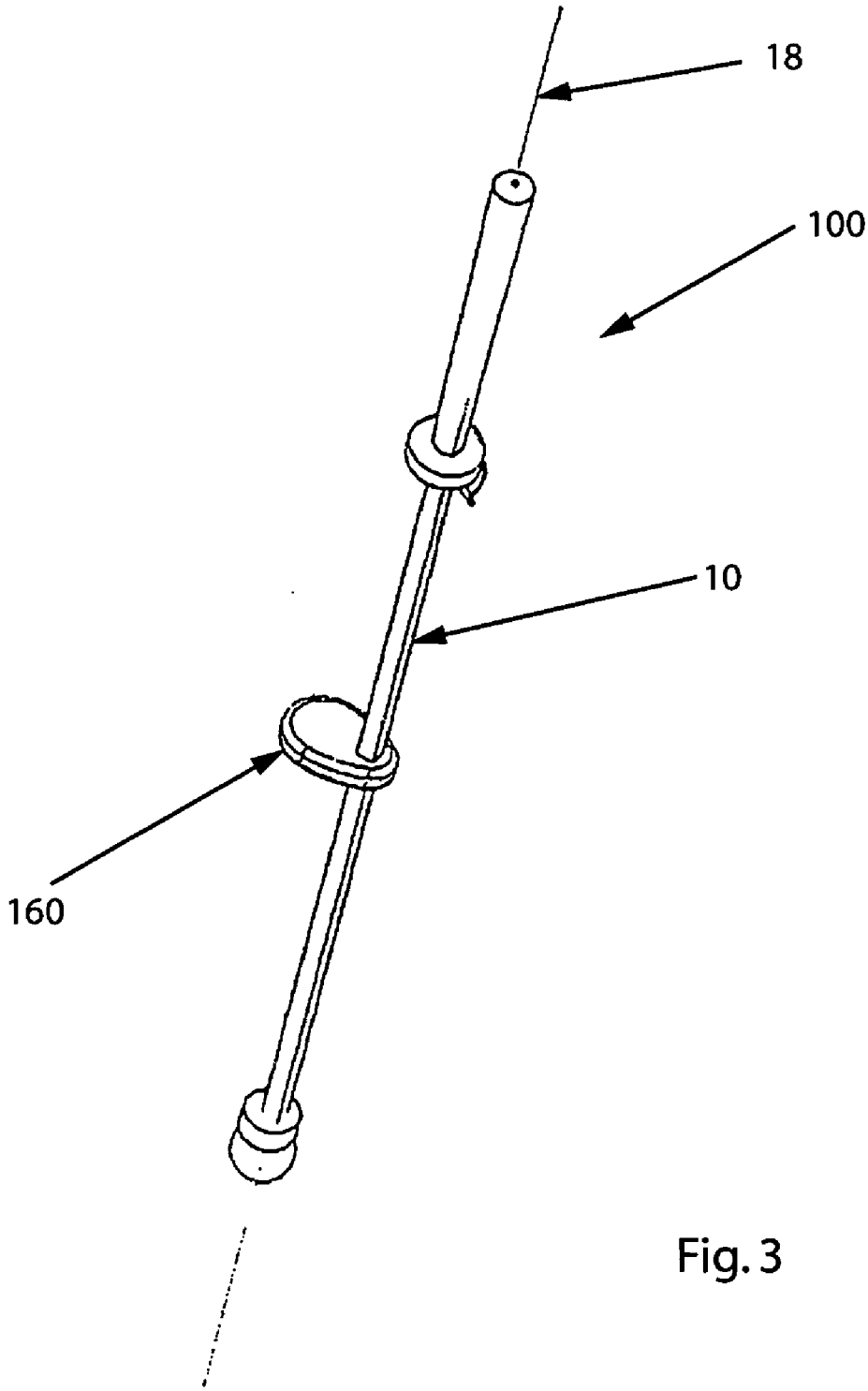
FIG. 3 is a perspective view of an alternative exemplary embodiment of a swing training apparatus of the present disclosure.
Figure 4:
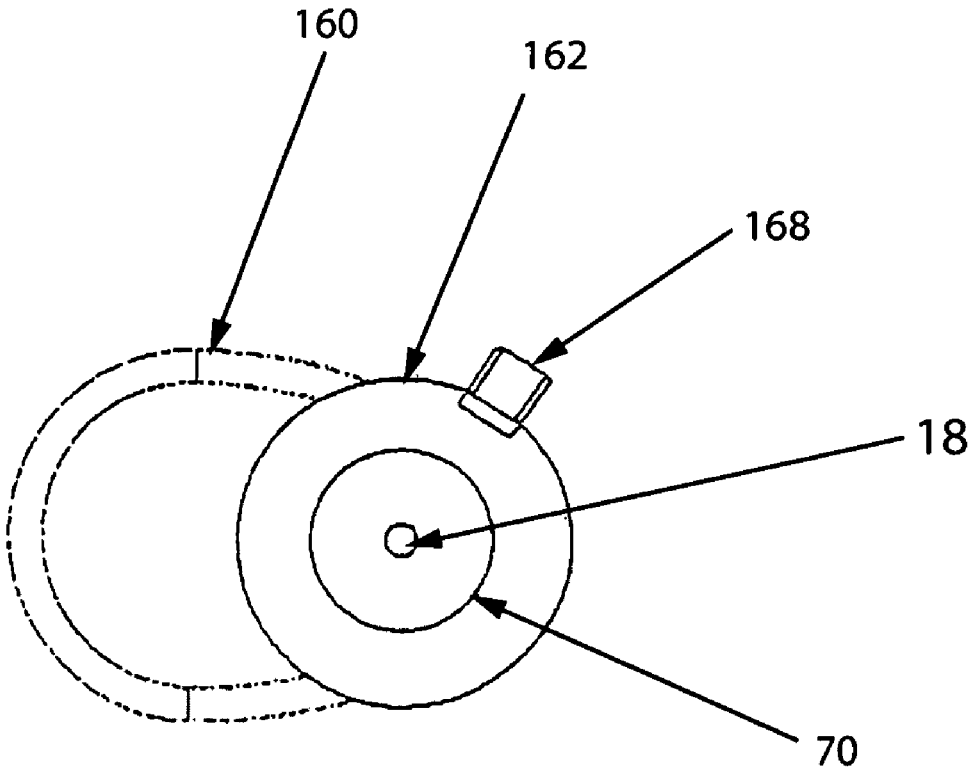
FIG. 4 is a top sectional view showing an alternative embodiment of a weight member oriented in a neutral position.

Referring now to FIGS. 3 and 4, there is illustrated swing trainer 100 having an alternative weight member designated as reference numeral 160. Similarly to weight member 60, weight member 160 is adapted and configured for slidable engagement with respect to shaft 10. Additionally, the configuration and size of the aperture formed in weight member 160 is adjusted to suit the cross-section of shaft 10. As shown, weight member 160 is oblong and is configured to have a center of gravity which is offset from axis 18.

Reference is now made to FIGS. 5–11, which describe a "model" swing using the swing trainer 100. Initially, as shown in FIG. 1, the weight member 60 starts in the "unloaded" position and potential energy has not yet been developed. However, as discussed earlier, the weight member 60 can be detachably retained by a retaining mechanism, e.g., clip 42 (see FIG. 1), and the swing initiated with the weight member 60 in the loaded position.

Figure 5:
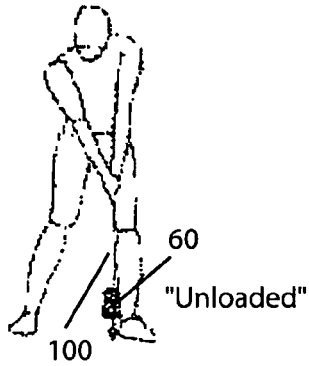
FIG. 5 is a front view of a golfer in the "address" position with the weight member in the "Unloaded" position.
Figure 6:
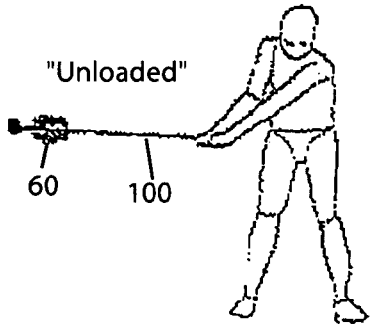
FIG. 6 is a front view of the golfer in the "¼ back" position with the weight member still "unloaded"
Figure 7:
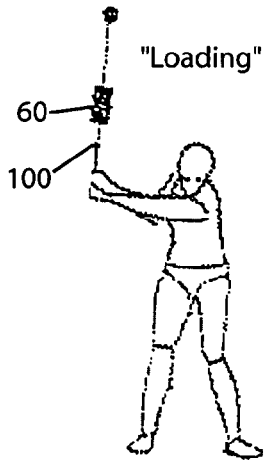
FIG. 7 is a front view of the golfer in the "½ way back" position illustrating the weight member sliding longitudinally toward the loaded position.
Figure 8:
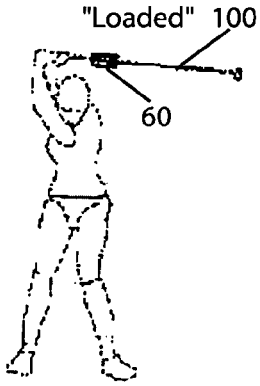
FIG. 8 is a front view of the golfer positioned so that the swing training apparatus is at the top of the backswing with the weight member fully loaded.
Figure 9:
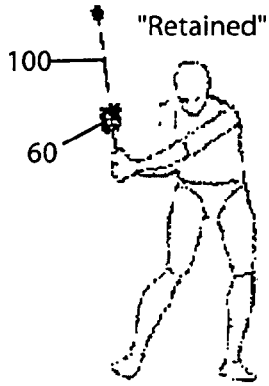
FIG. 9 is a front view of the golfer in the "½ way down" position with the weight member retained in the loaded position at the upper end of the swing training apparatus.
Figure 10:
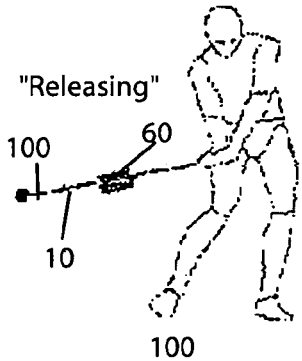
FIG. 10 is a front view of the golfer in a "delivery" position with the weight member energy being "released"
Figure 11:
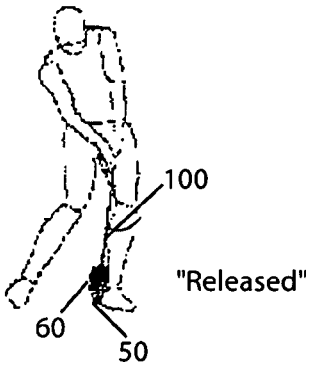
FIG. 11 is a front view of the golfer in an "impact" position with all of the energy of the weight member released.

The swing trainer 100 begins to travel through the backswing in FIG. 2 and the loading of the weight member is initiated when the golfer is in the position shown in FIG. 3. At the top of the swing, the weight member 60 is fully loaded. As the hands of the golfer begin to drop, the wrists remain cocked and the weight member 60 is retained in juxtaposition with upper sleeve 40, as shown in FIG. 5. In FIG. 6, the golfer is beginning to uncock his/her wrists, releasing the weight member 60 to slide axially down the shaft 10 of swing trainer 100. At the bottom of the swing, in the impact zone, the wrists snap, generating maximum clubhead speed. It is at this point that weight member 60 contacts the sleeve 50 providing tactile, visible and auditory feedback. In an improper swing, the weight member 60 contacts the sleeve 50 prior to reaching the impact zone and signals premature release of the potential energy.

Figure 12:
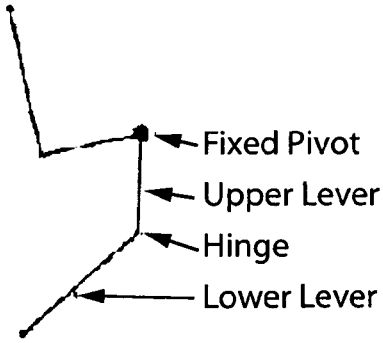
FIG. 12 is schematic representation of a physics model for an ideal "two-lever" swing showing both the "½ way down" and "delivery" positions.
Figure 13:
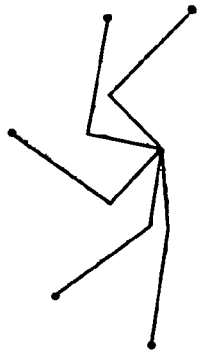
FIG. 13 is schematic representation of a physics model which illustrates the storing of swing energy resulting from maintaining the angle between the upper and lower levers when swinging from the top of the backswing to delivery.

Proven out by the analysis of a "two-lever" model as shown in FIGS. 12 and 13, the swing detailed in FIGS. 5–11 will deliver the highest clubhead velocity at the most critical stage, impact. When the "two-lever" model is examined closely (FIG. 12), it is readily apparent that as the club is being delivered, very little of the potential energy of the lower lever is released, i.e., less then 9%. It is known by those skilled in the art that the average golfer will prematurely "unload" the lower lever because of poor timing and a misguided effort to increase clubhead velocity. It is to this end that the present apparatus and associated method are designed, i.e., to eliminate this swing flaw. It has been demonstrated by stop-action photography and computer analysis of the leading professional golfers that their golf clubs mimic the actions of the scientific two-lever model, and an objective of the advantageous apparatus and method of the present disclosure is to train and make available to sports enthusiasts, e.g., a golfer, a means to learn such an action, thereby approximating such a swing.

Figure 14:
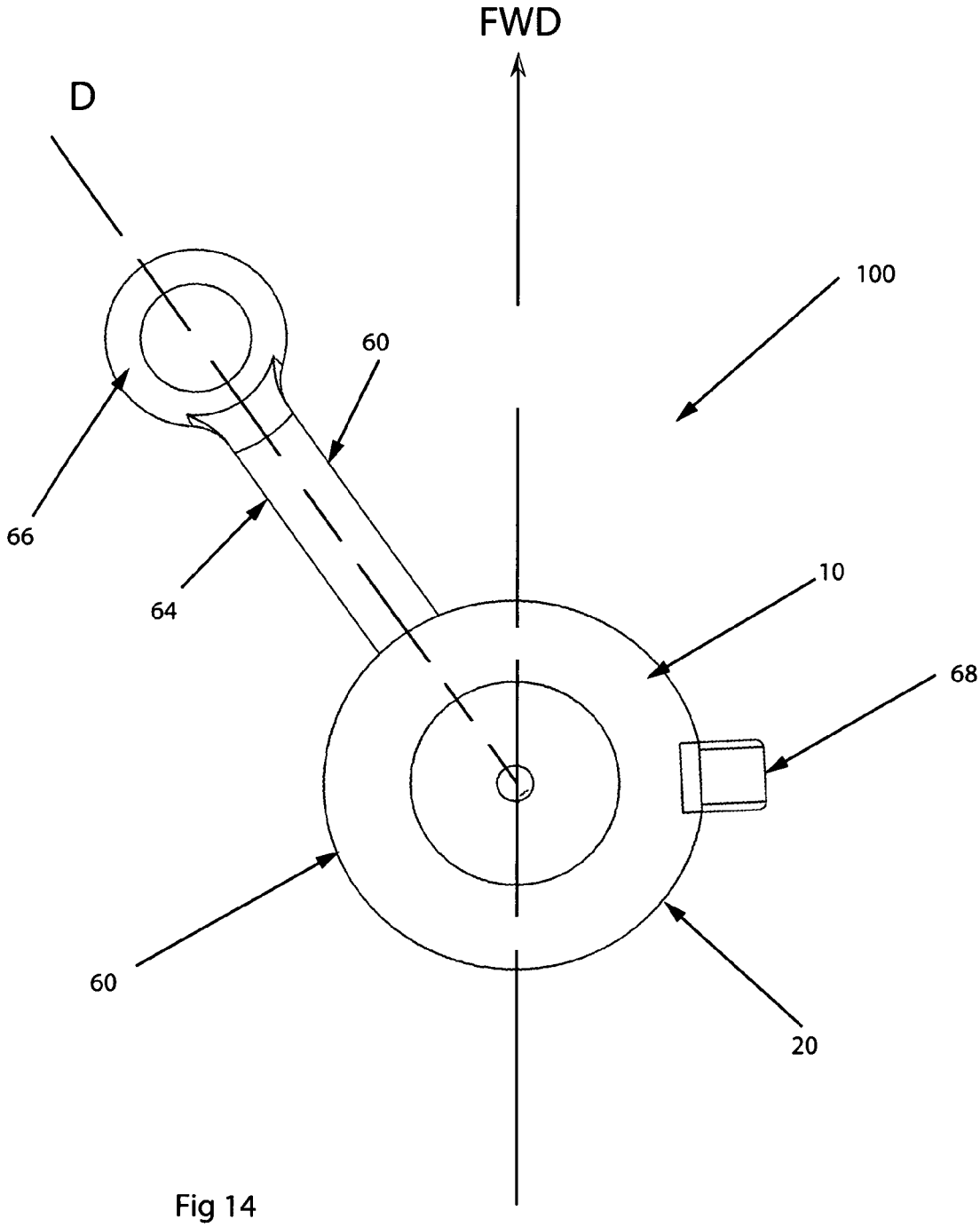
FIG. 14 is a top sectional view which illustrates a selectively adjustable angular relationship between a weight member and a golfer.

In addition to improving clubhead speed by helping the user to groove the model swing of FIGS. 5–11, swing trainer 100 also allows the user to improve his/her control over the ball's flight characteristics. Referring now to FIG. 14, an overhead view of swing trainer 100 is provided. When the golfer is holding the swing trainer 100 and is in the address position, he/she would be facing in the direction indicated by the "FWD" arrow and the target would be in the direction indicated by arrow "T". As noted herein, the weight member 60 has a center of gravity which is offset from the shaft axis and, therefore, imparts a torque on shaft 10 during the swing. Depending on the angular position of the weight member 60 with respect to the golfer, keeping in mind that the angular position is fixed by set screw 68, the torque imparted by weight member 60 acts to force the clubhead closed or open at the bottom of the swing.

Teaching professionals recognize that a golf ball flight which slices (i.e., curves to the right of the target on a right-handed golfer) is caused by the clubface being open (i.e., the heel being ahead of the toe) at impact with the ball. Conversely, a ball flight which hooks (i.e., curves to the left of the target on a right-handed golfer) is caused by the clubface being closed (i.e., the toe being ahead of the heel) at impact. If the angular position of weight member 60 with respect to the golfer is fixed to the left of the FWD arrow, as shown in FIG. 14, the torque imparted by weight member 60 will tend to close the clubface and provide the golfer with a feel for correcting a slicing problem. The degree to which the weight member is angled from FWD can be selectively adjusted according to exemplary embodiments of the present disclosure based on the magnitude of a golfer's slicing problem. Alternatively, if a golfer desires to learn how to impart a draw to the ball's flight (i.e., a slight hooking movement to the left of the target), positioning the weight member 60 to the left of FWD will provide tactile feel for creating this shot.

Correcting a hooking problem or creating a fade (i.e., a slight bend in the flight to the right on a right-handed golfer) can be accomplished in an opposite manner. More specifically, if the angular position of weight member 60 with respect to a golfer is fixed to the right of the FWD arrow, as indicated by the "F" directional line, the torque imparted by weight member 60 will tend to open the clubface and provide the golfer with a feel for correcting a hooking problem or creating a fade.

It should be noted that it is not necessary for the swing trainer to be configured such that the orientation of the weight member is adjustable. In an alternate embodiment, the golfer can simply turn the swing trainer 100 in his hands to adjust the angular relationship of the weight member 60 with respect to FWD. In this embodiment, it would be advantageous to provide markings on the grip which indicate the hand positions for correcting for a slice or a hook or for creating a draw or a fade.

Additionally, the weight member can be configured such that it can be secured directly to the shaft of a golf club. In this embodiment, the orientation of the weight member is preferably fixed with respect to the golfer's hands and the weight member does not slide longitudinally along the shaft. Alternatively, the weight member may slide along the shaft, but the orientation of the weight member may not be fixed with respect to the golfer's hands.

Additional exemplary embodiments of swing training apparatus and methods according to the present disclosure will now be described with reference to FIGS. 15–21. As noted above, these additional exemplary embodiments are described with reference to golf swing training applications. However, the advantageous principles, functions and structural features disclosed with reference to these additional embodiments may be readily extended to alternative sports training applications, e.g., a baseball swing training apparatus, a tennis swing training apparatus, a hockey swing training apparatus and a field hockey swing training apparatus.

Figure 15:
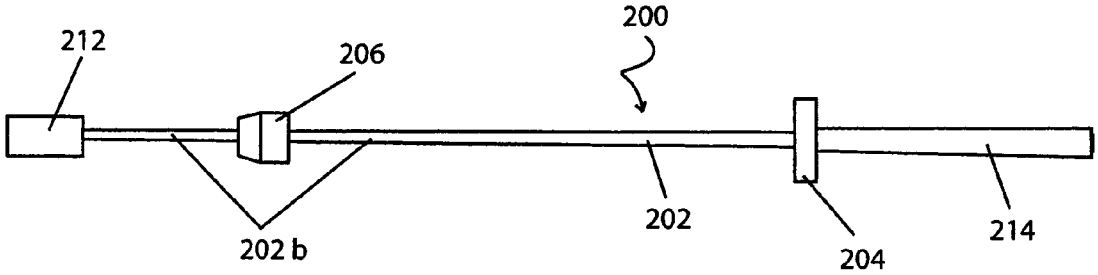
FIG. 15 is a side view of a further exemplary swing training apparatus according to the present disclosure.
Figure 16:
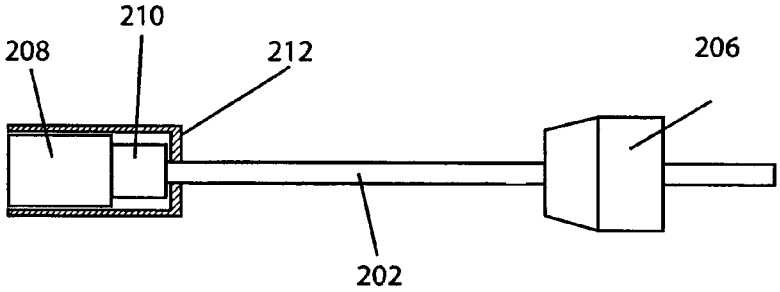
FIG. 16 is a side view of a distal portion of the exemplary swing training apparatus of FIG. 15.
Figure 17:
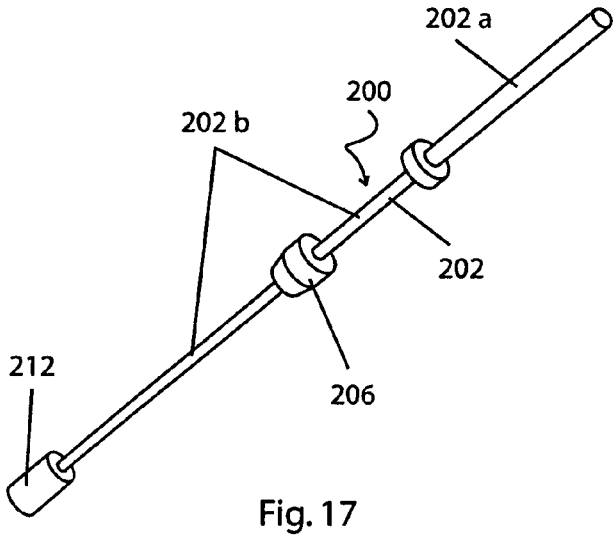
FIG. 17 is a perspective side view of an exemplary swing training apparatus corresponding to the training apparatus of FIGS. 15 and 16.

With initial reference to FIGS. 15–17, swing trainer 200 includes a shaft 202, an upper retainer 204, a slider 206, a weighted lower retainer 208 (see FIG. 18), a shock bushing 210 and a dampener housing 212. Shaft 202 is elongated and, based on the positioning of upper retainer 204 and lower retainer 208, defines a gripping portion 202*a* and an intermediate portion 202*b*. Shaft 202 may be hollow (in whole or in part) to receive weighting elements, e.g., to adjust the weighting parameters associated with the swing training device based on the characteristics of a given user. The lower retainer 208 is typically mounted to shaft 202 at or in close proximity to the distal end of shaft 202. Gripping portion 202*a* of shaft 202 may have a substantially cylindrical gripping member 214 mounted thereon or thereover, as is well known in the art of golfclubs.

The cross-sectional geometry of shaft 202 is generally selected from conventional cross-sectional geometries, e.g., circular, elliptical, square/rectangular, hexagonal, octagonal, etc. The geometry of the other structural elements associated with swing trainer 200 may also be varied without departing from the spirit or scope of the present disclosure. Thus, for example, upper retainer 204 is depicted as a substantially disc-like member with a central aperture for cooperation with the outer circumference of shaft 202. However, alternative geometries may be employed in fabricating upper retainer 204, e.g., a frustoconical geometry. Of note, upper retainer 204 is advantageously repositionable relative to shaft 202. Such repositioning may be desirable based on characteristics of the user, e.g., height, experience level, etc. In exemplary embodiments of the present disclosure, the upper retainer 204 may be repositioned relative to shaft 202 through a keying arrangement (e.g., where key slots are positioned at different axial locations along shaft 202), a locking collet mechanism internal to upper retainer 204, and like mechanisms. Once positioned relative to shaft 202, however, upper retainer 204 should not be susceptible to movement during use of swing trainer 200, e.g., as a result of the swinging of shaft 202, because injury may result.

Figure 18:
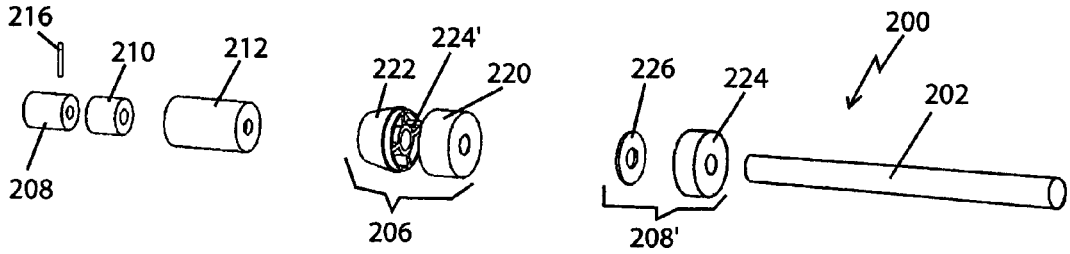
FIG. 18 is an exploded perspective view of the exemplary swing training apparatus shown in FIG. 17, with parts separated and a shortened shaft element.
Figure 19:
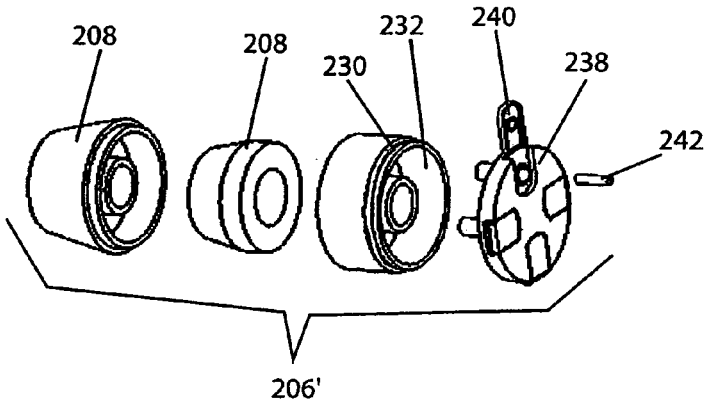
FIG. 19 is an exploded perspective view of an exemplary slider, with parts separated, according to an embodiment of the present disclosure.

Exemplary slider 206, as shown in FIGS. 17–19, features an upper region that is of a substantially cylindrical geometry and a lower region that is of a substantially frustoconical geometry, both regions featuring a central aperture for cooperation with shaft 202. Alternative geometric configurations may be employed in fabricating slider 206. Finally, lower retainer 208, shock busing 210 and dampener housing 212 are each depicted with a substantially cylindrical geometry, although alternative geometries may be employed, as will be readily apparent to persons skilled in the art.

Slider 206 is configured and dimensioned for sliding motion relative to shaft 202. Thus, the central aperture formed in slider 206 is typically dimensioned to provide an appropriate clearance relative to shaft 206 so as to permit sliding movement relative to shaft 202 with limited friction therebetween. The clearance is typically limited, however, so as to avoid undesirable eccentricities between slider 206 and shaft 202. Once mounted on shaft 202, e.g., by sliding thereon from either the proximal or distal end, slider 206 is bounded in its axial motion by the fixed positioning of upper retainer 204 and lower retainer 210 relative to shaft 202.

Turning to FIG. 18, additional advantageous features associated with an exemplary slider 206 and an exemplary upper retainer 204 will now be described. Initially, however, it is noted that a pin 216 may be employed to fix lower retainer 208 relative to shaft 202, e.g., by passage into an appropriately positioned mounting aperture formed therein. With further reference to FIG. 18, exemplary slider 206 is of two part construction, featuring substantially cylindrical upper section 220 and substantially frustoconical lower section 222. In the exemplary embodiment of FIG. 18, the lower section 222 defines a hollow region 224 that is sized and configured to receive and retain magnetic elements (not pictured) therewithin. Hollow region 224 may be defined as a single, undivided region or a plurality of segmented regions. The magnetic elements that are introduced to hollow region 224 are retained therewithin when upper section 220 is secured to lower section 222, e.g., by screw threading, bayonet-lock, sonic welding, adhesive or the like. Prior to securing upper section 220 relative to lower section 222, the weight of slider 206 may be adjusted by introducing (or withdrawing) ballast material 225 (which is shown removed from hollow region 224), e.g., pelletized materials, powdered materials, solid materials or the like.

With further reference to FIG. 18, upper retainer 204 is fabricated as a two-part subassembly, with upper cylindrical body 224 cooperating to engage washer 226. Washer 226 is advantageously fabricated from a material that responds to the magnetism of the magnetic elements positioned within slider 206. For example, washer 226 may be advantageously fabricated from a steel material. Alternative constructions of upper retainer 204 may be employed to provide a magnetically responsive structural arrangement, e.g., magnetically responsive materials may be embedded in molded components of upper retainer 204 or a magnetically responsive material may be positioned within upper retainer 204. Thus, the present disclosure is not limited to a structural arrangement whereby a distally-positioned washer 226 is incorporated into upper retainer 204 so as to provide the desired magnetically responsive functionality.

In use, when cocked (as described with reference to the preceding swinger trainer apparatus and methods), slider 206 comes into engagement with upper retainer 206. The interaction between the magnetic elements positioned within slider 206 and the magnetically responsive washer 226 associated with upper retainer 204 function as a mechanism to detachably maintain slider 206 in juxtaposition with upper retainer 204. As the user's swing commences, a downward force on slider 206 is generated through the centrifugal force of the swing. Provided the swing generates an adequate centrifugal force, the magnetic force between slider 206 and upper retainer 204 is overcome and slider 206 moves distally along shaft 202 at an accelerating speed. As slider 206 approaches the distal end of shaft 202, it contacts dampener housing 212 which is driven toward lower retainer 208 and comes into contact therewith. Shock bushing 210 dampens the force associated with the contact of dampener housing 212 with lower retainer 208. Nonetheless, dampener housing 212 contacts lower retainer 208 with significant force, yielding a distinct audible sound and tactile sensation to the user.

Shock bushing 210 may be fabricated from a suitable resilient material, e.g., a rubber, foam or other spring-like material. Shock bushing 210 advantageously reduces the overall force associated with distal travel of slider 206 and the associated contact with lower retainer 208, i.e., the combination of shock bushing 210 with slider 206 and lower retainer 208 provides an advantageous shock absorbing mechanism for purposes of swing trainer 200. Alternative structural arrangements are contemplated, e.g., mounting of an appropriate bushing member directly to the dampener housing. Of note, lower retainer 208 is weighted so as to provide the appropriate functionality to swing trainer 200. Lower trainer 208 also advantageously functions to maintain the centricity of the distal elements associated with swing trainer 200. A first lower retainer 208 having a first weight may be replaced by a second lower retainer 208 having a second weight, e.g., based on characteristics of the individual using swing trainer 200.

The interaction between magnetized slider 206 and magnetically responsive upper retainer 208 offers advantageous functionality to the disclosed swing trainer 200. The magnetic elements may be adjusted in location, in magnetic property and/or in quantity so as to adjust the retaining force associated with the interaction between slider 206 and upper retainer 208. Moreover, the disclosed magnetic retaining mechanism is reliable, cost effective and self-contained, thereby facilitating manufacture, assembly and use thereof.

Turning to FIG. 19, a further exemplary embodiment of the disclosed magnetic retaining mechanism is depicted. In the depicted embodiment, slider 206' includes a cylindrical upper member 230 that defines a hollow region 232 for receipt of magnetic elements 242. A cover 238 is mounted to upper member 230. The cover 238 includes a plurality of flaps 240 (four) that may be moved between an open position (allowing access to the hollow region 232) and a closed position, e.g., based on a living hinge arrangement. The flaps 240 of cover 238 facilitate introduction and removal of magnetic elements to and from slider 206'. In addition, ballast may be introduced/removed from slider 206 by opening one or more flaps 240 and accessing the space therebelow.

Slider 206' defines an internal region for receipt and retention of metallic elements 242 and/or ballast. A lower member 236 of slider 206' may receive such ballast, e.g., in the form of conical filler element 234 that may be selected based upon its weight, and lower member 236 may be secured to upper member 230 to define slider 206'. Thus, when fully assembled, slider 206' functions much like slider 206 (discussed above with reference to FIG. 18). The magnetic elements positioned within slider 206' are adapted to interact with the magnetically responsive structure associated with upper retainer 208 to define an advantageous retaining mechanism. The force associated with the retaining mechanism may be adjusted by adding/removing magnetic elements from slider 206' (i.e., by opening flaps 240 associated with cover 238), by repositioning conical member 234 within slider 206' (i.e., "upward" to increase the magnetic force, "downward" to reduce the magnetic force), and/or adjusting the weight of slider 206' (e.g., by adding or removing ballast from slider 206' through flaps 240 of cover 238).

Figure 20:
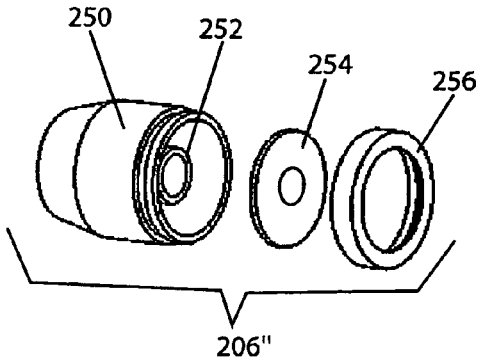
FIG. 20 is an exploded perspective view of a further exemplary slider, with parts separated, according to an embodiment of the present disclosure.
Figure 21:
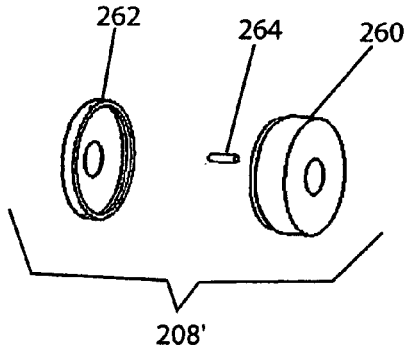
FIG. 21 is an exploded perspective view of an exemplary upper retainer, with parts separated, according to an embodiment of the present disclosure.

Turning to FIGS. 20 and 21, an alternative restraining mechanism is described with reference to an alternative slider 206" and an alternative upper retainer 208'. Slider 206" includes a frustoconical body 250 that defines a cavity 252 and a magnetically responsive washer 254 that is advantageously fixed relative to body 250 by a nut 256. Ballast may be added to slider 206", as desired. Slider 206" is adapted to cooperate with upper retainer 208' that includes a hollow disc-member 260, a cover 262 and one or more metallic elements 264. Metallic elements 264 are positioned within hollow disc-member 260 and cover 262 is positioned thereon (e.g., by threading, bayonet-lock, adhesive, sonic weld or the like), so as to secure the metallic elements within upper retainer 208'. Cover 262 may include "flaps" so as to permit flip-top access to the storage region therewithin, thereby facilitating ease of adjustment thereto. In use, slider 206" comes into contact with upper retainer 208', e.g., when swinging trainer 200 is cocked, and slider 206" is detachably retained in juxtaposition relative to upper retainer 208' by the magnetic forces exerted therebetween.

Thus, according to the present disclosure, exemplary embodiments wherein a retaining mechanism is defined by cooperative magnetic elements, are disclosed. These embodiments include numerous structural and functional benefits, including advantageous adjustability in weight/magnetic attraction, reliability and self-contained ease of use.

Additional functionalities may be incorporated into any one of the disclosed swing training apparatus of the present disclosure. These additional functionalities are as follows:

With reference to FIG. 18, the lower retainer, shock bushing and/or dampener housing associated with the swing training apparatus may include a light 280 that is adapted to illuminate when the slider reaches the impact position. Mechanisms for effectuating such illumination are known, e.g., a piezoelectric or contact switch 282 may be employed. The color, duration, diffusive properties and direction of the illumination may be variously implemented, according to the present disclosure. For example, the light beam may be directed radially outward or axially (upward or downward). The point at which the light 280 is illuminated may be helpful for the user and/or his coach in assessing attributes associated with the user's swing, e.g., the timing thereof.

The lower retainer, shock bushing and/or dampener housing associated with the swing training apparatus may include a sound chip 290 that is actuated when the slider reaches the impact position. Again, mechanisms are known for effectuating the actuation of a sound chip 290 based upon impact/contact of a moving member, e.g., piezoelectric or contact switch 282. The sound chip 290 may emit a variety of sounds, e.g., the sound of a club striking a ball, the sound of a crowd cheering or the like. The point at which the sound is emitted may be helpful for the user and/or his coach in assessing attributes associated with the user's swing, e.g., the timing thereof.

The dampener housing may also include a further "swing plane tracking device."

While the invention has been described with respect to preferred embodiments, those skilled in the art will readily appreciate that various changes and/or modifications can be made to the invention without departing from the spirit or scope of the invention as defined by the appended claims.

What is claimed is:

1. An apparatus for improving a swing of an individual, comprising:

(a) a shaft having an upper portion, a lower portion and a central portion extending therebetween and defining a longitudinal axis;

(b) a member slidably mounted with respect to the central portion of the shaft and adapted and configured for movement between the upper portion and the lower portion of the shaft, said slidable member defining a fully enclosed accessible hollow region;

(c) first means located in the upper portion of the shaft for preventing the slidable member from sliding over the upper portion of the shaft;

(d) retaining means associated at least in part with the first means, said retaining means functioning to restrain axial movement of the slidable member along the shaft until a pre-selected restraining force is overcome; and (e) second means located at the lower portion of the shaft for preventing the slidable member from becoming disassociated from the shaft wherein the weight of said slidable member is adjustable by introducing or withdrawing material from said fully enclosed accessible hollow region.

2. An apparatus according to claim 1, wherein the retaining means includes one or more magnetic elements positioned within the slidable member and a magnetically responsive structure associated with said first means.

3. An apparatus according to claim 1, wherein the retaining means includes one or more magnetic elements positioned within the first means and a magnetically responsive structure associated with said slidable member.

4. An apparatus according to claim 1, further comprising an amount of ballast positioned within said accessible hollow region of said slidable member, wherein said amount of ballast may be adjusted by adding or removing ballast from said slidable member.

5. An apparatus according to claim 1, wherein said second means includes a lower retainer, a shock brushing and a dampener housing.

6. An apparatus according to claim 1, wherein the swing relates to a sport selected from the group consisting of golf, baseball, tennis, hockey and field hockey.

7. An apparatus according to claim 1, further comprising a lighting element associated with said second means, said lighting element being illuminated in response to said slidable member moving into contact with said second means.

8. An apparatus according to claim 1, further comprising a sound-emitting element associated with said second means, said sound-emitting element being actuated in response to said slidable member moving into contact with said second means.

9. An apparatus for improving a swing of an individual, comprising:

(a) a shaft that defines a longitudinal axis;

(b) an upper retainer that is positioned at a first location relative to said shaft;

(c) a lower retainer that is positioned at a second location relative to said shaft;

(d) a slidable member that is mounted with respect to said shaft for movement between said upper retainer and said lower retainer, said slidable member defining a fully enclosed accessible hollow region; and (e) a retaining mechanism associated at least in part with said upper retainer member, said retaining mechanism functioning to retain said slidable member in juxtaposition with said upper retainer member until a predetermined force is effected through swinging of said shaft;

wherein the weight of said slidable member is adjustable by introducing or withdrawing material from said fully enclosed accessible hollow region.

10. An apparatus according to claim 9, wherein said retaining mechanism includes magnetic elements positioned within said slidable member and a magnetically responsive structure being associated with said upper retainer.

11. An apparatus according to claim 10, wherein the position of said magnetic elements is repositionable within said slidable member so as to adjust said predetermined force.

12. An apparatus according to claim 9, wherein said retaining mechanism includes magnetic elements positioned within said upper retainer and a magnetically responsive structure being associated with said slidable member.

13. An apparatus according to claim 9, further comprising a lighting element associated with said lower retainer, said lighting element being illuminated in response to said slidable member moving into contact with said lower retainer.

14. An apparatus according to claim 9, further comprising a sound-emitting element associated with said lower retainer, said sound-emitting element being actuated in response to said slidable member moving into contact with said lower retainer.

15. A method for improving a swing of an individual, comprising:

(a) providing a swing training apparatus, said swing training apparatus including:

(i) a shaft that defines a longitudinal axis;

(ii) an upper retainer that is positioned at a first location relative to said shaft;

(iii) a lower retainer that is positioned at a second location relative to said shaft;

(iv) a slidable member that is mounted with respect to said shaft for movement between said upper retainer and said lower retainer, said slidable member defining a fully enclosed accessible hollow region; and (v) a retaining mechanism associated at least in part with said upper retainer member, said retaining mechanism functioning to retain said slidable member in juxtaposition with said upper retainer member until a predetermined force is effected through swinging of said shaft;

(b) adjusting the weight of said slidable member by introducing or withdrawing material from said accessible hollow region;

(c) employing said swing training apparatus by swinging said shaft; and (d) receiving feedback from said swing training apparatus regarding the swinging of the shaft.

* * * * *